US010233709B2

(12) United States Patent
Meador et al.

(10) Patent No.: US 10,233,709 B2
(45) Date of Patent: Mar. 19, 2019

(54) TOP SET LINER HANGER AND PACKER WITH HANGER SLIPS ABOVE THE PACKER SEAL

(71) Applicants: Charles M. Meador, Cypress, TX (US); Matthew J. Krueger, Houston, TX (US); Mark E. Ramey, Houston, TX (US)

(72) Inventors: Charles M. Meador, Cypress, TX (US); Matthew J. Krueger, Houston, TX (US); Mark E. Ramey, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 224 days.

(21) Appl. No.: 15/259,246

(22) Filed: Sep. 8, 2016

(65) Prior Publication Data

US 2018/0066486 A1 Mar. 8, 2018

(51) Int. Cl.

| | |
|---|---|
| ***E21B 33/128*** | (2006.01) |
| ***E21B 33/129*** | (2006.01) |
| ***E21B 23/06*** | (2006.01) |
| ***E21B 23/01*** | (2006.01) |

(52) U.S. Cl.

CPC ..... *E21B 23/01* (2013.01); *E21B 33/128* (2013.01); *E21B 33/129* (2013.01)

(58) Field of Classification Search

CPC ..... E21B 33/128; E21B 33/129; E21B 23/06
See application file for complete search history.

(56) References Cited

U.S. PATENT DOCUMENTS

| | | | | |
|---|---|---|---|---|
| 4,307,781 | A * | 12/1981 | Preston, Jr. | E21B 33/1292 166/123 |
| 4,662,453 | A | 5/1987 | Brisco | |
| 4,753,444 | A | 6/1988 | Jackson et al. | |
| 6,431,277 | B1 | 8/2002 | Cox et al. | |
| 6,467,540 | B1 * | 10/2002 | Weinig | E21B 23/01 166/120 |
| 7,383,891 | B2 * | 6/2008 | Fay | E21B 23/04 166/120 |
| 7,546,872 | B2 | 6/2009 | McGilvray, Jr. et al. | |
| 8,322,450 | B2 | 12/2012 | Meijer | |
| 2004/0036225 | A1 | 2/2004 | Ritter et al. | |
| 2009/0294137 | A1 | 12/2009 | Meijer | |
| 2014/0238689 | A1 * | 8/2014 | Hughes | E21B 33/1291 166/377 |
| 2015/0034299 | A1 | 2/2015 | Burckhard | |
| 2015/0315849 | A1 | 11/2015 | Stautzenberger et al. | |

(Continued)

OTHER PUBLICATIONS

Notification of Transmittal of the International Search Report and the Written Opinion of the International Searching Authority, or the Declaration; PCT/US2017/045271; dated Nov. 15, 2017; 12 pages.

*Primary Examiner* — Kenneth L Thompson
(74) *Attorney, Agent, or Firm* — Cantor Colburn LLP

(57) ABSTRACT

A system of tubulars includes a non-expandable mandrel having a body including an uphole end, a downhole end, and an outer surface. The non-expandable mandrel includes one or more slip members that are outwardly extendable relative to the outer surface. A seal assembly is arranged at the downhole end of the non-expandable mandrel. The seal assembly is settable after outward expansion of the one or more slip members.

13 Claims, 9 Drawing Sheets

(56) References Cited

U.S. PATENT DOCUMENTS

| | | | | |
|---|---|---|---|---|
| 2016/0010421 | A1* | 1/2016 | Henderson | E21B 33/124 166/250.01 |
| 2018/0087347 | A1* | 3/2018 | Rochen | E21B 33/1293 |

* cited by examiner

TOP SET LINER HANGER AND PACKER WITH HANGER SLIPS ABOVE THE PACKER SEAL

BACKGROUND

Resource exploration systems employ a system of tubulars that extend from a surface downhole into a formation. The tubulars often include components having adjustable portions such as hangers, packers, screens and the like that may be remotely activated. Often times, remote activation includes introducing tools from the surface into the system of tubulars. The adjustable portions, such as slips, valves and the like may create localized diameter changes of the downhole tubular. That is, portions of the downhole tubular may include components or tubulars having increased wall thickness associated with the adjustable portions that create localized diameter changes of the downhole tubular system. Reducing an overall number of diameter changes in a system of tubulars can lead to an overall cost savings in well bore construction and operation.

SUMMARY

A system of tubulars includes a non-expandable mandrel having a body including an uphole end, a downhole end, and an outer surface. The non-expandable mandrel includes one or more slip members that are outwardly extendable relative to the outer surface. A seal assembly is arranged at the downhole end of the non-expandable mandrel. The seal assembly is settable after outward expansion of the one or more slip members.

A method of setting a downhole seal assembly includes deploying a system of tubulars including a non-expandable mandrel including an uphole portion and a downhole portion. The downhole portion includes a seal assembly. The method also includes setting one or more slip members carried by the uphole portion of the non-expandable mandrel, transmitting an axial force through the non-expandable mandrel into the seal assembly after setting the one or more slips and radially expanding the seal assembly in response to the axial force.

BRIEF DESCRIPTION OF THE DRAWINGS

Referring now to the drawings wherein like elements are numbered alike in the several Figures.

DETAILED DESCRIPTION

Figure 1:
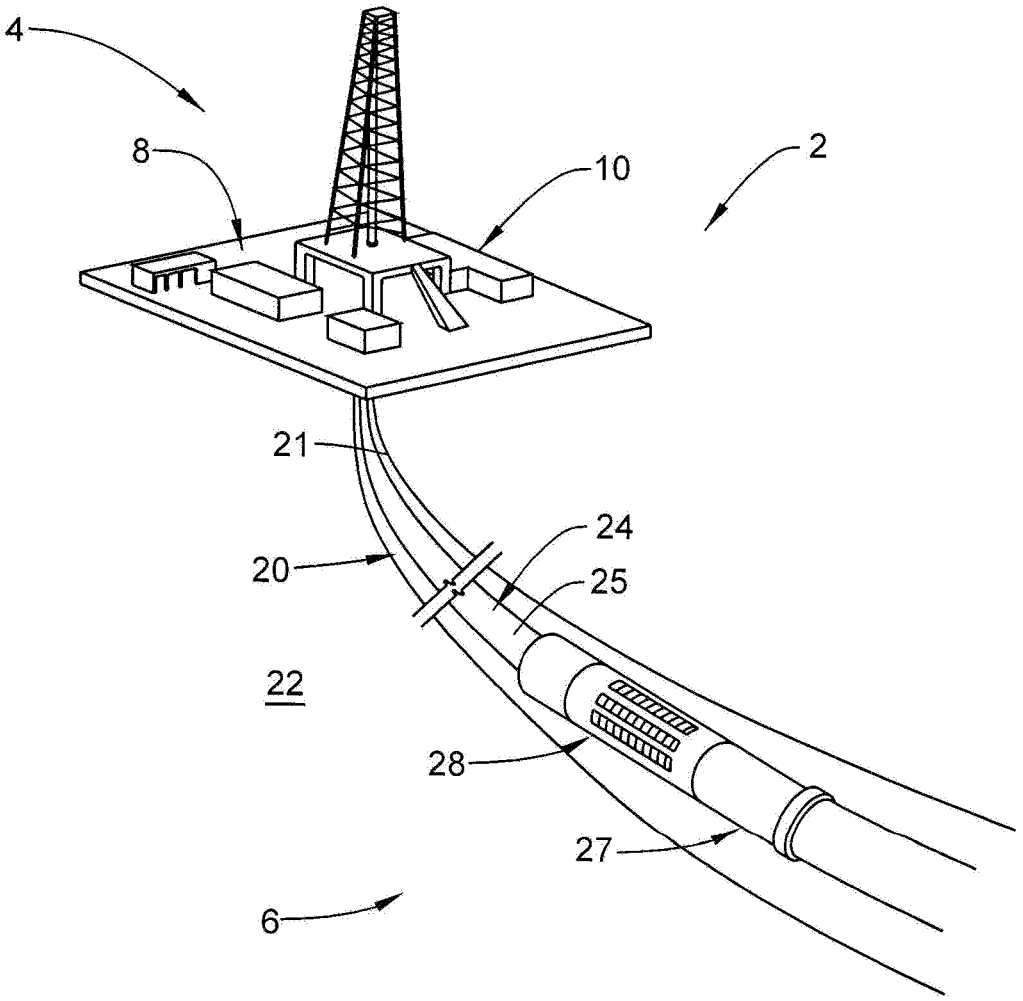
FIG. 1 depicts a resource exploration system including a seal assembly, in accordance with an exemplary embodiment.

A resource exploration system, in accordance with an exemplary embodiment, is indicated generally at 2, in FIG. 1. Resource exploration system 2 should be understood to include well drilling operations, resource extraction and recovery, $CO_2$ sequestration, and the like. Resource exploration system 2 may include a surface system 4 operatively connected to a downhole system 6. Surface system 4 may include pumps 8 that aid in completion and/or extraction processes as well as fluid storage 10. Fluid storage 10 may contain a gravel pack fluid or slurry (not shown) that is introduced into downhole system 6.

Downhole system 6 may include a system of tubulars 20 that are extended into a wellbore 21 formed in formation 22. System of tubulars 20 may be formed from a number of connected downhole tools or tubulars 24 and include a liner top extension 25 that extend downhole to a seal assembly 27 through a non-expandable hanger or mandrel 28. Seal assembly 27 is selectively deployed downhole of mandrel 28 in order to isolate one portion of wellbore 21 from another portion of wellbore 21. It is to be understood that the term "non-expandable mandrel" is meant to describe a mandrel that does not deform radially to engage walls of wellbore 21 or a well casing if present.

Figure 2:
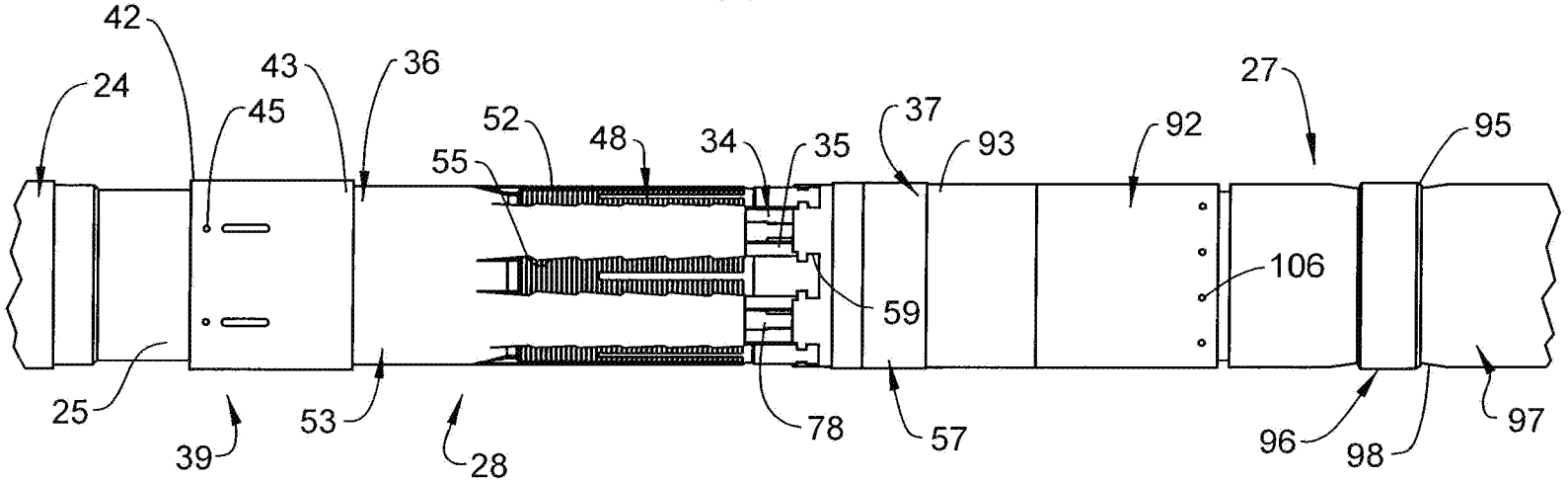
FIG. 2 depicts a plan view of the seal assembly, in accordance with an aspect of an exemplary embodiment.
Figure 3:
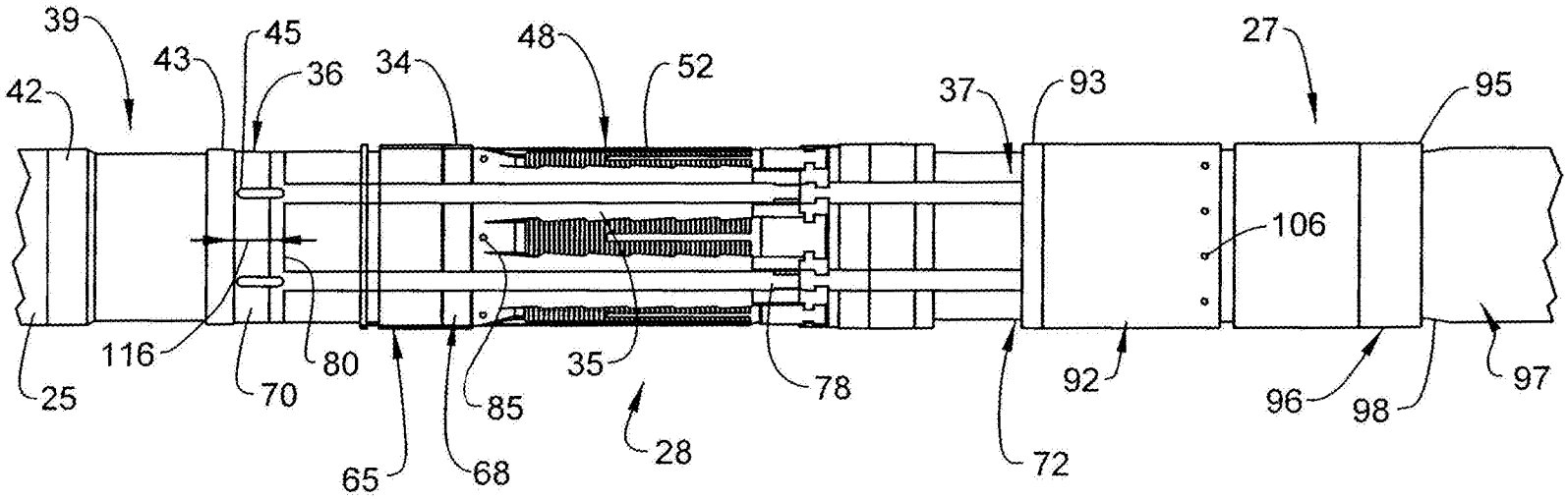
FIG. 3 depicts the seal assembly of FIG. 2 without a slip seat.

In accordance with an aspect of an exemplary embodiment illustrated in FIGS. 2-3, non-expandable mandrel 28 includes a body 34 having an outer surface 35, an inner surface (not separately labeled), an uphole end 36, and a downhole end 37 mechanically coupled to seal assembly 27. A decoupling sleeve 39 is mechanically coupled to uphole end 36. Decoupling sleeve 39 includes an uphole end portion 42 that receives liner top extension 25 and a downhole end portion 43. Decoupling sleeve 39 supports a first plurality of shear members 45 that are designed to shear upon being exposed to a first force. It is to be understood that the particular type of shear members employed may vary.

Non-expandable mandrel 28 supports a plurality of slip members, one of which is indicated at 48. Slip members 48 include surface features 52 and may be radially outwardly extended to affix non-expandable mandrel 28 at a desired position relative to wellbore 21. Non-expandable mandrel 28 is also shown to include a slip seat 53 (FIG. 2) that partially covers body 34. Slip seat 53 includes a plurality of windows, one of which is indicated at 55, which provide an opening through which each slip member 48 may extend. A cover ring 57 (FIG. 2) may be provided to partially cover another portion of body 34 adjacent downhole end 37. Cover ring 57 includes window portions 59 that are positioned to accommodate radial outward movement of slip members 48. Once deployed, surface features 52 on slip members 48 bite into wall portions (not separately labeled) of wellbore 21 to affix non-expandable mandrel 28.

Non-expandable mandrel 28 also includes a lock ring 65 (FIG. 3) having a plurality of ridges 67 (FIG. 7) arranged near uphole end 36, a locking member 68 downhole from lock ring 65, a first load ring 70 arranged near uphole end 36 and a second load ring 72 arranged at downhole end 37. A plurality of load bars, one of which is indicated at 78 extends between first load ring 70 and second load ring 72. A load bar link 80 is arranged at first load ring 70 and mechanically links each of the plurality of load bars 78. As will be detailed below, load bars 78 transfer an axial load from decoupling sleeve 39 to seal assembly 27. Body 34 of non-expandable mandrel 28 includes a second plurality of shear members 85 that are designed to shear upon being exposed to a second force, which is less than the first force. Shear members 85 prevent axial loading of the plurality of load bars 78 prior to setting slip members 48.

Seal assembly 27 includes a seal body 92 including an uphole end section 93 coupled to downhole end 37 of non-expandable mandrel 28 and a downhole end section 95 that supports a seal member 96. Downhole end section 95 extends to a mandrel 97 having a tapered end 98. As will be detailed below, seal assembly 27 is shifted toward mandrel 97 causing a radial outward expansion of seal member 96. Seal member 96 engages with side walls (not separately labeled) of wellbore 21. Seal member 96 fluidically isolates one portion (downhole) of wellbore 21 from another portion (uphole) of wellbore 21. Seal assembly 27 includes a third plurality of shear members 106 that are designed to shear upon being exposed to a third force, which may be substantially equal to the second force. Tapered end 98 of mandrel 97 is positioned at downhole end 37. The particular design of mandrel 97 including tapered end 98 ensures that a wall thickness (not shown) of mandrel 97 below the seal element 94 is equivalent or greater than a cross-sectional dimension of an associated liner. Therefore, pressure containment ratings of this system preserve liner pressure ratings.

Figure 4:
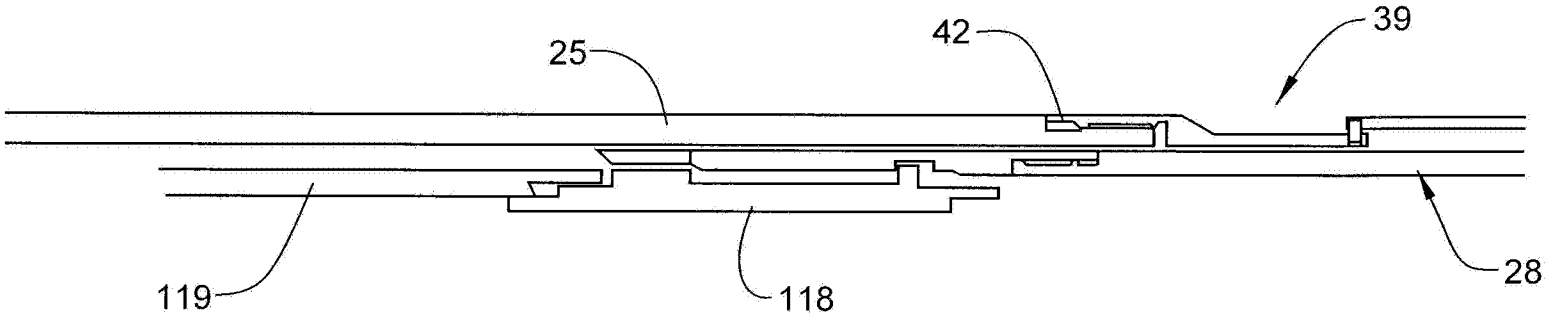
FIG. 4 depicts a partial cross-sectional view of an uphole end of the seal assembly, in accordance with an aspect of an exemplary embodiment.

Prior to setting, a gap 116 exists between decoupling sleeve 39 and first load ring 70 as shown in FIG. 3. Gap 116 is sized to be greater than an expected travel of decoupling sleeve 39 when setting slip members 48. A tool 118, as shown in FIG. 4 is run into a system of tubulars 20 as part of a drill string 119 that extends from surface system 4 to set slip members 48. Tool 118, which may take the form of a pusher tool, applies an axial force to the liner top extension which moves axially into non-expandable mandrel 28 causing the second plurality of shear members 85 to shear.

Figure 5:
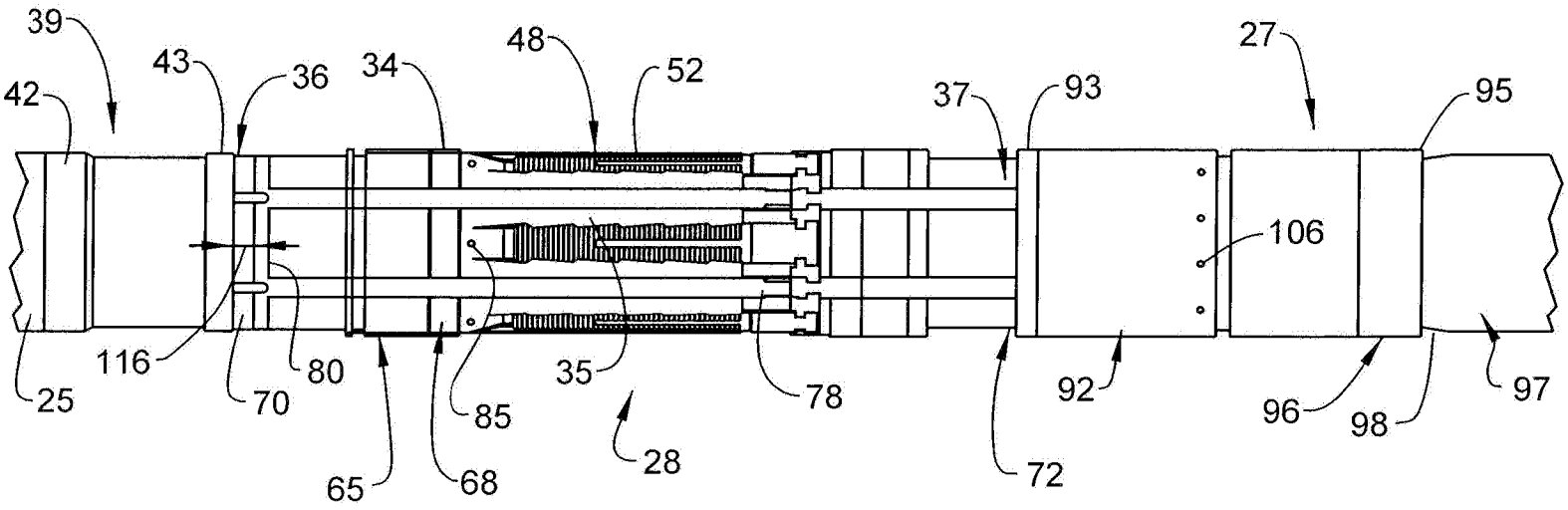
FIG. 5. depicts the seal assembly of FIG. 3 after setting a plurality of slip members.

For example, the tool may include a ball seat (not shown). An activation ball (also not shown) may be introduced into wellbore 21 and guided to the ball seat. Fluid may be introduced into wellbore 21 to a selected pressure. The applied force passes through decoupling sleeve 39 into non-expandable mandrel 28 causing the second plurality of shear members 85 to shear allowing slip seat 53 to deploy slip members 48 as shown in FIG. 5. At this point, the activation ball may be extruded. Tool 118 includes a designed amount of axial stroke. The axial stroke achieved while setting slip member 48 after the second shear member 85 shears, is not sufficient to load any other shear members of seal assembly 27, e.g. shear members 45 and 106.

Figure 6:
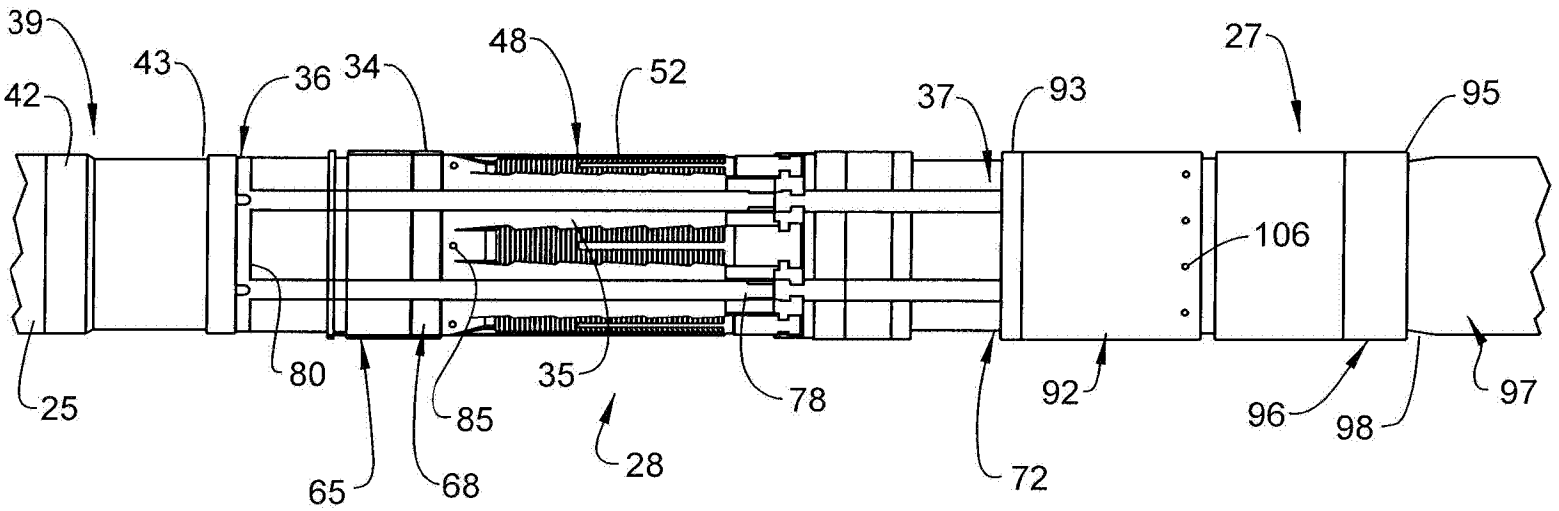
FIG. 6 depicts the seal assembly of FIG. 5 following axial shifting of a decoupling sleeve arranged at the uphole end.

At this point the tool may be released and a downhole operation, such as cementing may take place. After cementing, set down weight of system of tubulars 20 causes first plurality of shear members 45 to shear allowing decoupling sleeve 39 to shift further closing gap 116 as shown in FIG. 6. The set down weight passes into first load ring 70, through load bars 78 to second load ring 72 and into seal body 92 causing the third plurality of shear members 106 to shear allowing seal member 96 to travel onto tapered end 98 and expand radially outwardly creating an annular seal against an internal surface of wellbore 21.

Figure 7:
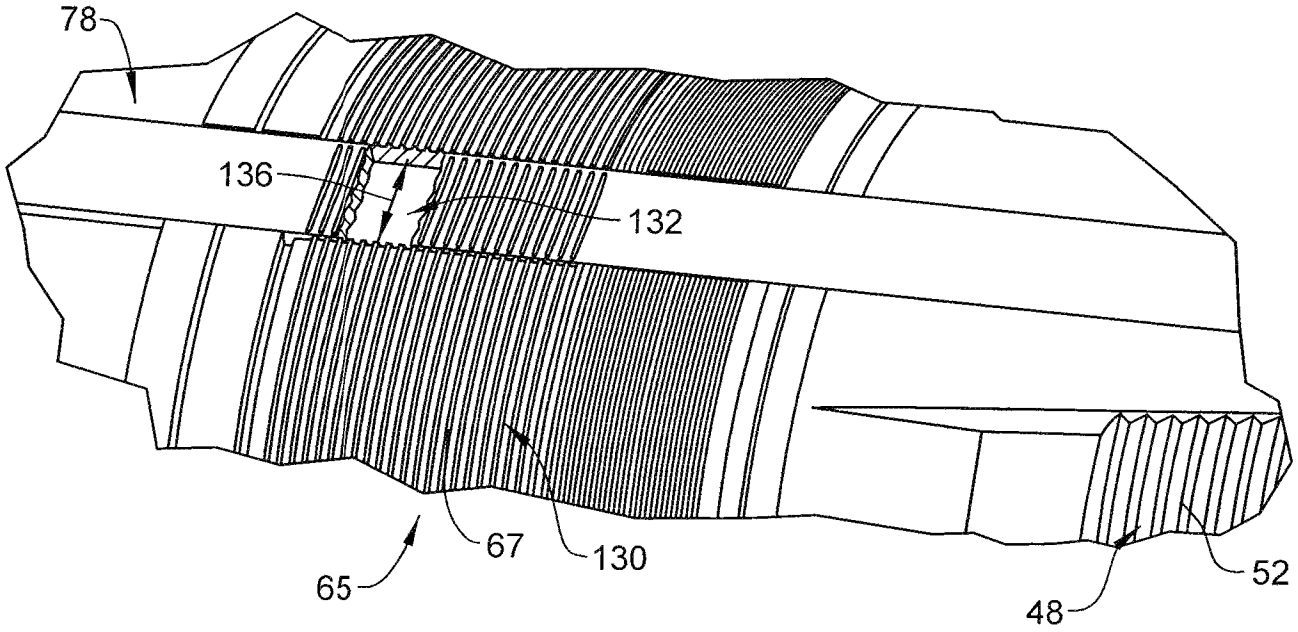
FIG. 7 depicts a partial cut-away view of a load bar passing between lock ring segments, in accordance with an aspect of an exemplary embodiment.

In accordance with an aspect of an exemplary embodiment illustrated in FIG. 7, load bars 78 extend along non-expandable mandrel with little, if any, increase in outer diameter. More specifically, load bars 78 pass between one or more locking ring segments 130 that collectively form lock ring 65. Adjacent locking ring segments 130 are separated by a channel 132 that forms a gap 136 sized to receive one of load bars 78.

Figure 8:
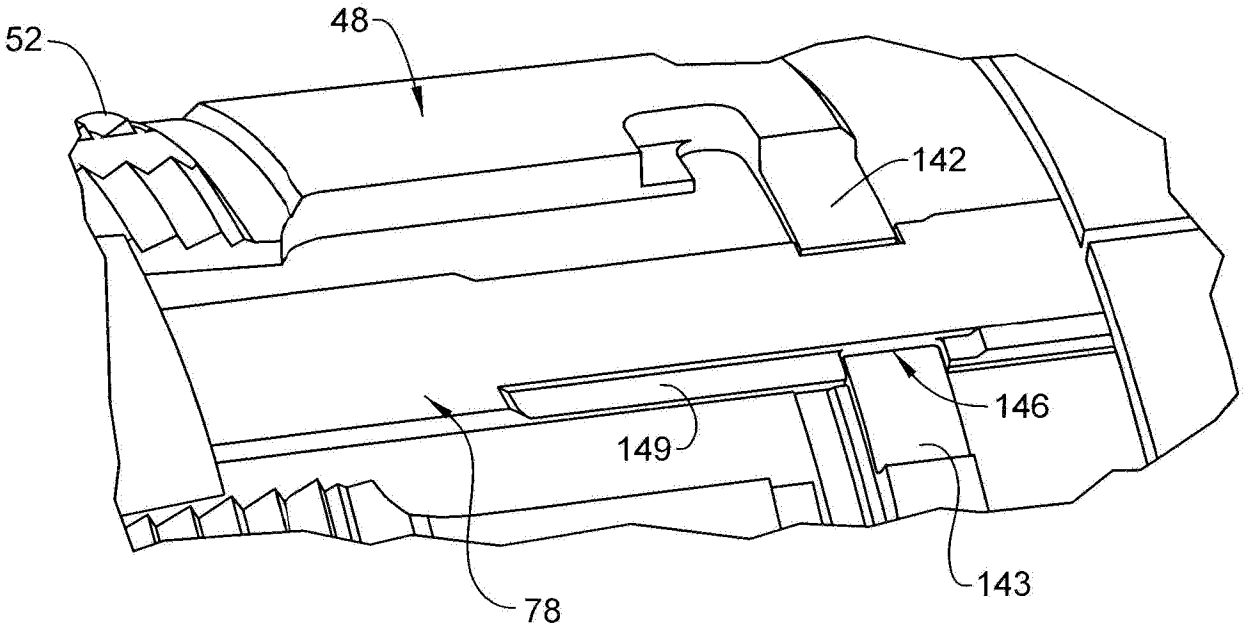
FIG. 8 depicts slip members engaged with a downhole end of a load bar, in accordance with an aspect of an exemplary embodiment.
Figure 9:
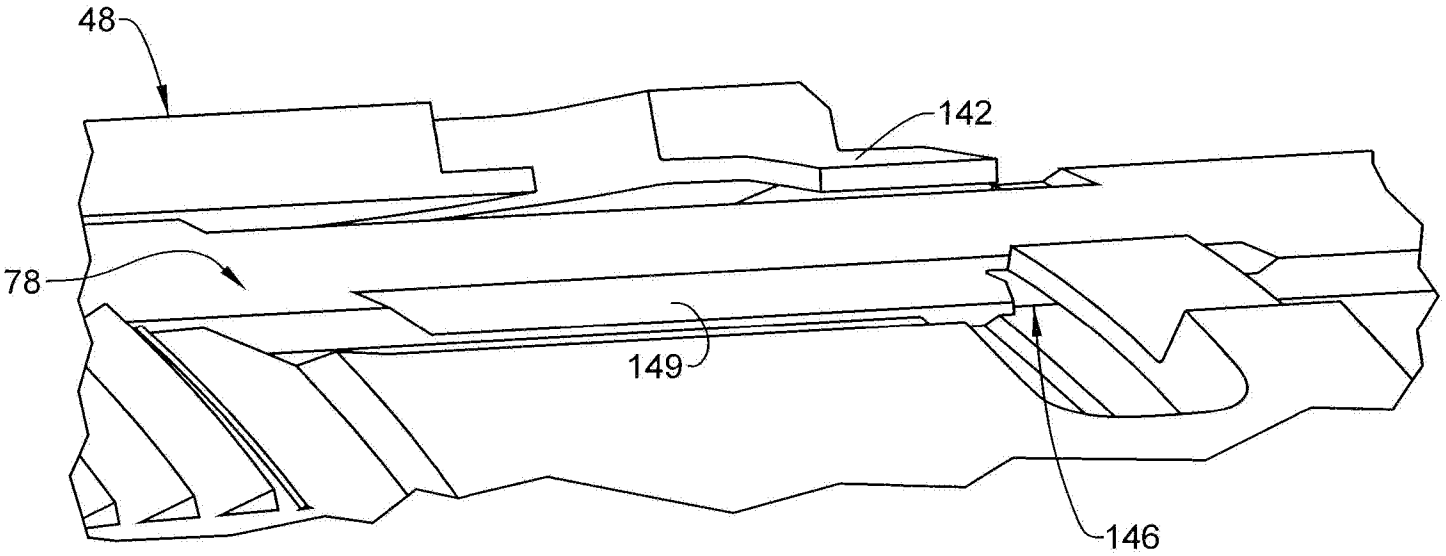
FIG. 9 depicts the slip member of FIG. 8 disengaging from the load bar during setting, in accordance with an aspect of an exemplary embodiment.

In accordance with another aspect of an exemplary embodiment illustrated in FIGS. 8 and 9, each slip member 48 includes a pair of tab members such as seen at 142 and at 143 on an adjacent slip member 48. Prior to deployment of slip members 48, tab members 142 and 143 nest within tab receiving recesses 146 formed in each load bar 78. Each load bar 78 also includes a reduced thickness portion 149 to accommodate shorter deployment of slip members 48. In this manner, slip members 48 will lock load bars 78 into place during deployment of system of tubulars 20 and setting of non-expandable mandrel 28. Once slip member 48 are set, load bars 78 may move freely to transmit an axial force from decoupling sleeve 39 to seal assembly 27 to set seal member 96.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

Embodiment 1

A system of tubulars comprising: a non-expandable mandrel having a body including an uphole end, a downhole end, and an outer surface, the non-expandable mandrel including one or more slip members that are outwardly extendable relative to the outer surface; and a seal assembly arranged at the downhole end of the non-expandable mandrel, the seal assembly being settable after outward expansion of the one or more slip members.

Embodiment 2

The system of tubulars according to embodiment 1, further comprising: a decoupling sleeve coupled to the non-expandable mandrel at the uphole end, the decoupling sleeve including a first plurality of more shear members shearable at a first force.

Embodiment 3

The system of tubulars according to embodiment 2, wherein the non-expandable mandrel includes a second plurality of shear members shearable at a second force that is less than the first force.

Embodiment 4

The system of tubulars according to embodiment 3, wherein the seal assembly includes a third plurality of shear members shearable at a third force that is substantially equal to the second force.

Embodiment 5

The system of tubulars according to embodiment 2, wherein the non-expandable mandrel includes a first load ring arranged at the uphole end and a second load ring arranged at the downhole end, and a plurality of load bars extending between the first load ring and the second load ring.

Embodiment 6

The system of tubulars according to embodiment 5, further comprising: a locking ring mounted to the non-expandable mandrel between the first load ring and the second load ring, the locking ring including a plurality of lock ring segments and a plurality of channels that provide passage for respective ones of the plurality of load bars.

Embodiment 7

The system of tubulars according to embodiment 6, wherein the locking ring is formed from a plurality of locking ring segments, the plurality of channels being defined by gaps between adjacent ones of the plurality of locking ring segments.

Embodiment 8

The system of tubulars according to embodiment 5, wherein each of the one or more slip members includes a tab members that selectively engages at least one of the plurality of load bars, the tab members preventing axial movement of the plurality of load bars prior to deployment of the one or more slip members.

Embodiment 9

The system of tubulars according to embodiment 8, wherein each of the plurality of load bars includes at least one tab receiving recess receptive to a corresponding tab members of one of the one or more slip members.

Embodiment 10

A method of setting a downhole seal assembly comprising: deploying a system of tubulars including a non-expandable mandrel including an uphole portion and a downhole portion, the downhole portion including a seal assembly; setting one or more slip members carried by the uphole portion of the non-expandable mandrel; transmitting an axial force through the non-expandable mandrel into the seal assembly after setting the one or more slips; and radially expanding the seal assembly in response to the axial force.

Embodiment 11

The method of embodiment 10, wherein setting the one or more slip members includes applying a first axial force to an uphole end of the non-expandable mandrel causing a first plurality of shear members to shear.

Embodiment 12

The method of embodiment 11, wherein transmitting the axial force to the non-expandable mandrel includes applying a second axial force, that is greater than the first axial force, to a decoupling sleeve arranged at the uphole end causing a second plurality of shear members to shear.

Embodiment 13

The method of embodiment 10, wherein transmitting the axial force to the non-expandable mandrel includes inputting the axial force to one or more load bars carried by the non-expandable mandrel after setting the one or more slip members.

Embodiment 14

The method of embodiment 13, further comprising: restricting axial movement of the one or more load bars relative to the non-expandable mandrel prior to setting the one or more slip members.

Embodiment 15

The method of embodiment 12, wherein radially expanding the seal assembly includes applying the second axial force to the seal assembly causing a third plurality of shear members to shear.

The terms "about" and "substantially" are intended to include the degree of error associated with measurement of the particular quantity based upon the equipment available at the time of filing the application. For example, "about" can include a range of ±8% or 5%, or 2% of a given value.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. A system of tubulars comprising:

a non-expandable mandrel having a body including an uphole end, a downhole end, and an outer surface, the non-expandable mandrel including one or more slip members that are outwardly extendable relative to the outer surface, wherein the non-expandable mandrel includes a first load ring arranged at the uphole end and a second load ring arranged at the downhole end, and a plurality of load bars extending between the first load ring and the second load ring; and a seal assembly arranged at the downhole end of the non-expandable mandrel, the seal assembly being settable after outward expansion of the one or more slip members.

2. The system of tubulars according to claim 1, further comprising: a decoupling sleeve coupled to the non-expandable mandrel at the uphole end, the decoupling sleeve including a first plurality of more shear members shearable at a first force.

3. The system of tubulars according to claim 2, wherein the non-expandable mandrel includes a second plurality of shear members shearable at a second force that is less than the first force.

4. The system of tubulars according to claim 3, wherein the seal assembly includes a third plurality of shear members shearable at a third force that is substantially equal to the second force.

5. The system of tubulars according to claim 1, further comprising: a locking ring mounted to the non-expandable mandrel between the first load ring and the second load ring, the locking ring including a plurality of lock ring segments and a plurality of channels that provide passage for respective ones of the plurality of load bars.

6. The system of tubulars according to claim 5, wherein the locking ring is formed from a plurality of locking ring segments, the plurality of channels being defined by gaps between adjacent ones of the plurality of locking ring segments.

7. The system of tubulars according to claim 1, wherein each of the one or more slip members includes a tab members that selectively engages at least one of the plurality of load bars, the tab members preventing axial movement of the plurality of load bars prior to deployment of the one or more slip members.

8. The system of tubulars according to claim 7, wherein each of the plurality of load bars includes at least one tab receiving recess receptive to a corresponding tab members of one of the one or more slip members.

9. A method of setting a downhole seal assembly comprising:

deploying a system of tubulars including a non-expandable mandrel including an uphole portion and a downhole portion, the downhole portion including a seal assembly;

setting one or more slip members carried by the uphole portion of the non-expandable mandrel;

transmitting an axial force through the non-expandable mandrel into the seal assembly after setting the one or more slips by inputting the axial force to one or more load bars carried by the non-expandable mandrel after setting the one or more slip members; and radially expanding the seal assembly in response to the axial force.

10. The method of claim 9, wherein setting the one or more slip members includes applying a first axial force to an uphole end of the non-expandable mandrel causing a first plurality of shear members to shear.

11. The method of claim 10, wherein transmitting the axial force to the non-expandable mandrel includes applying a second axial force, that is greater than the first axial force, to a decoupling sleeve arranged at the uphole end causing a second plurality of shear members to shear.

12. The method of claim 9, further comprising: restricting axial movement of the one or more load bars relative to the non-expandable mandrel prior to setting the one or more slip members.

13. The method of claim 11, wherein radially expanding the seal assembly includes applying the second axial force to the seal assembly causing a third plurality of shear members to shear.

* * * * *